US009816410B2

(12) United States Patent
Torella

(10) Patent No.: US 9,816,410 B2
(45) Date of Patent: Nov. 14, 2017

(54) SEPARATOR DEVICE FOR A SYSTEM FOR RECIRCULATION OF THE BLOW-BY GASES OF AN INTERNAL COMBUSTION ENGINE

(75) Inventor: Enrico Torella, Orbassano (IT)

(73) Assignee: FIAT POWERTRAIN TECHNOLOGIES S.P.A., Turin (IT)

( * ) Notice: Subject to any disclaimer, the term of this patent is extended or adjusted under 35 U.S.C. 154(b) by 452 days.

(21) Appl. No.: 13/116,606

(22) Filed: May 26, 2011

(65) Prior Publication Data

US 2011/0290225 A1 Dec. 1, 2011

(30) Foreign Application Priority Data

May 26, 2010 (EP) ..... 10425180

(51) Int. Cl.
*F02B 25/06* (2006.01)
*F01M 13/04* (2006.01)
(Continued)

(52) U.S. Cl.
CPC ..... *F01M 13/04* (2013.01); *F01M 13/022* (2013.01); *F01M 13/023* (2013.01);
(Continued)

(58) Field of Classification Search
CPC ..... F01M 13/04; F01M 2013/0461
(Continued)

(56) References Cited

U.S. PATENT DOCUMENTS 4,274,369 A * 6/1981 Rhoads ..... F02B 19/06 123/51 A
5,996,561 A * 12/1999 Watanabe ..... 123/572
(Continued)

FOREIGN PATENT DOCUMENTS

DE 20 2005 009 990 U1 11/2006
DE 10 2006 041 213 A1 3/2008
(Continued)

OTHER PUBLICATIONS

European Search Report, dated Sep. 22, 2010, and completed on Sep. 16, 2010, for corresponding European Application No. 10425180.6, filed on May 26, 2010.

*Primary Examiner* — Lindsay Low
*Assistant Examiner* — Omar Morales
(74) *Attorney, Agent, or Firm* — Heslin Rothenberg Farley & Mesiti P.C.; Victor A. Cardona, Esq.

(57) ABSTRACT

A separator device for a system for recirculation of the blow-by gases of an internal combustion engine includes a casing containing a separation chamber and having an inlet for communication with the engine crankcase and an outlet for communication with the engine intake manifold, and drainage outlets ending in the engine crankcase, for returning the liquid separated in the separation chamber into the engine crankcase. Actuator means sensitive to pressure in the engine crankcase are associated to the inlet and to the drainage outlets so that when the pressure in the engine crankcase is higher than the pressure in the separator device, the inlet is open and the drainage outlets are closed, while when the pressure in the engine crankcase is lower than the pressure in the separator device, the inlet is closed and the drainage outlets are open.

12 Claims, 5 Drawing Sheets

(51) Int. Cl.
*F01M 13/02* (2006.01)
*F01M 13/00* (2006.01)

(52) U.S. Cl.
CPC ..... *F01M 2013/005* (2013.01); *F01M 2013/0044* (2013.01); *F01M 2013/045* (2013.01); *F01M 2013/0461* (2013.01); *F01M 2013/0488* (2013.01); *F01M 2013/0494* (2013.01)

(58) Field of Classification Search
USPC ..... 123/572, 573, 41.86, 90.38
See application file for complete search history.

(56) References Cited

U.S. PATENT DOCUMENTS 6,345,614 B1 * 2/2002 Shureb ..... 123/572
7,055,470 B2 * 6/2006 Kreuter et al. ..... 123/51 A
2002/0011222 A1 * 1/2002 Bilek ..... F01B 1/12 123/52.1
2004/0261776 A1 * 12/2004 Knaus ..... F01M 13/022 123/572
2005/0092267 A1 * 5/2005 Nonaka ..... F01M 13/0416 123/41.86
2007/0017192 A1 * 1/2007 Bednarek et al. ..... 55/405
2007/0295315 A1 * 12/2007 Guerry et al. ..... 123/572
2008/0223347 A1 * 9/2008 Hommes ..... F01M 13/022 123/572
2009/0199826 A1 8/2009 Meinig et al.
2009/0301449 A1 12/2009 Ogawa et al.
2010/0006075 A1 * 1/2010 Ruppel et al. ..... 123/573

FOREIGN PATENT DOCUMENTS

EP 1 790 836 A2 5/2007
EP 2 146 061 A1 1/2010

* cited by examiner

FIG. 4
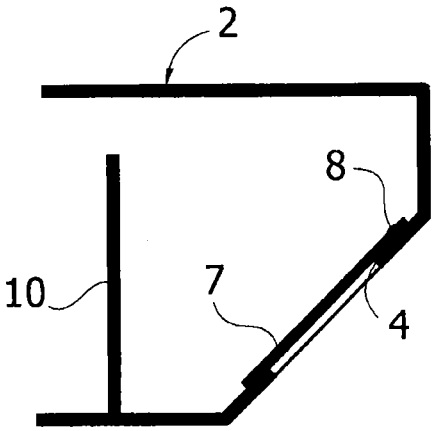
FIG. 5
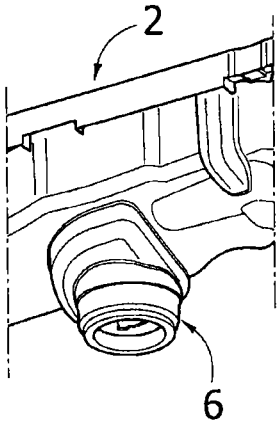
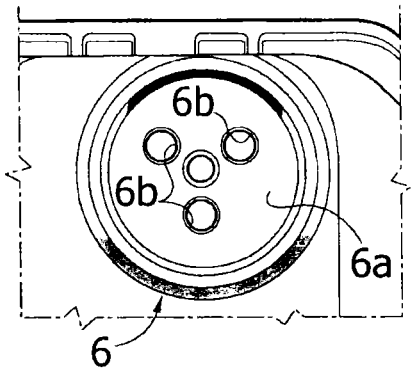
FIG. 6

SEPARATOR DEVICE FOR A SYSTEM FOR RECIRCULATION OF THE BLOW-BY GASES OF AN INTERNAL COMBUSTION ENGINE

CROSS REFERENCE TO RELATED APPLICATIONS

This application claims priority from European Patent Application No. 10425180.6, filed on May 26, 2010, the entire disclosure of which is incorporated herein by reference.

The present invention refers to separator devices used in recirculation systems for blow-by gases of internal combustion engines, of the type comprising a casing containing a separation chamber and having an inlet for communication with the engine crankcase, a main outlet for communication with the engine intake system and one or more drainage outlets ending in the engine crankcase for discharging the separated liquid into the separation chamber.

In the internal combustion engines, after having separated and returned the oil mixed thereto to the engine crankcase in form of vapour and/or droplets, the blow-by gases leak through the clearance between the pistons and engine cylinders, passing from the cylinders to the engine crankcase, are recirculated to the engine intake. Therefore, the task of the separator device is that of allowing the recirculation of the blow-by gases, in the system for supplying air, to the engine, simultaneously preventing the liquid particles from ending up in the intake.

In engines with three or more cylinders, except for particular cases, the pressure in the engine crankcase is almost constant over a rotation of the engine shaft. As a matter of fact, the balance between the upwards and downwards strokes of the various pistons is such that the engine crankcase maintains the volume thereof almost unvaried during the operation. In particular, regarding the four in-line cylinders engines, the volume of the engine crankcase remains substantially constant, in that while two pistons move towards the top dead centre the other two pistons move towards the bottom dead centre.

In such engines, a pressure regulation valve (PRV) of the diaphragm and spring type or a nozzle with cross-section variable by means of a shutter (PCV: Positive Crankcase Ventilation Valve) are used with the aim of maintaining the engine crankcase under vacuum at any operating condition. Such valves are used to provide communication between the engine crankcase and an environment subjected to vacuum, typically the engine intake manifold; possibly, a further connection with the intake system, regulated by a valve, so as to generate a fresh airflow from outside the crankcase (positive crankcase ventilation) may also be provided with the aim of reducing the level of contamination of the oil and increase duration thereof. Such valves are capable of correctly performing their task in that the instantaneous pressure in the engine crankcase is scarcely variable. Obviously, when the intake system generates insufficient vacuum (high loads and/or supercharge conditions) the engine crankcase cannot be maintained under vacuum.

In the in-line two cylinder engines with 360° offset of the engine cycles (i.e. of the type where the two pistons move in the same direction, so that they move together towards the top dead centre and towards the bottom dead centre), as well as in the single cylinder engines, the instantaneous pressure in the engine crankcase is significantly variable, due to the considerable variation of the volume of the engine crankcase within a rotation of the engine shaft connected to the motion of the pistons in the same direction. In this case, the use of valves of the previously described type does not allow obtaining a correct regulation of the pressure. With engines of this type, even the liquid/gas separation is complex, due to the reciprocating motion of this mixture in the separator. In the three or four cylinder engines the motion of the mixture may be intermittent but not reciprocal.

Systems of the type indicated in the preamble of claim 1 are known from EP 2 146 061 A1, US 2004/261776 A1, DE 20 2005 009990 U1.

SUMMARY OF THE INVENTION

The object of the present invention is that of providing a separator device useable with advantage particularly with in-line two-cylinder engines with zero degree offset cranks or in single-cylinder engines, with the aim of obtaining an ideal separation action, an efficient drainage of oil towards the engine crankcase and maintaining the engine crankcase under vacuum at any operating condition, regardless of the availability of an environment under vacuum.

According to the invention, such object is attained due to the fact that a separator device is provided having the characteristics indicated in claim 1.

Due to such solution, in the application of the device according to the invention to an in-line two cylinder engine with pistons moving in the same direction, when the pistons move towards the bottom dead centre, so as to reduce the volume in the engine crankcase and increase the pressure therein, the actuator means associated to the inlet of the separator device open and allow the entry of the gas and liquid mixture into the separator device. Under such condition, the actuator means associated to the drainage outlets are closed. When the direction of motion of the pistons is inverted and the pressure in the engine crankcase reduces, the actuator means on the inlet of the separator device close, while the actuator means associated to the drainage outlets open. Thus, the oil separated in the separator device may return into the engine crankcase.

In such step, the vacuum in the engine crankcase creates an airflow coming from the engine intake through the outlet of the separator device, the internal chamber of the separator device and the abovementioned drainage outlets. Such airflow has the purpose of draining the separated liquid and cleaning the engine crankcase, thus contributing to reduce the contamination of oil by the blow-by gases. Therefore, with the device according to the invention it is possible to obtain a positive crankcase ventilation), without using a PRV valve or the like.

Furthermore, according to a further characteristic of the invention, the entire section for passage through the drainage outlets of the separator device is much smaller than the section for passage to the inlet of the separator device. Thus, the negative half wave of the pressure cycle in the engine crankcase has a larger area with respect to the positive half wave and the average pressure in the engine crankcase is consequently negative. Generally, the size of the drainage passages has an impact on the vacuum level generated in the engine crankcase.

The present invention has the object of providing both the separator device independently and an internal combustion engine using the separator device of the invention, particularly a single cylinder engine or an in-line two cylinder engine with pistons moving in the same direction.

BRIEF DESCRIPTION OF THE DRAWINGS

Further characteristics and advantages of the invention shall be apparent from the description that follows referring to the attached drawings, provided purely by way of non-limiting example, wherein:

FIG. 4 is a sectional view of the detail of FIG. 3, FIG. 5 is a perspective view of a further detail of FIG. 1, FIG. 6 is a bottom view of one of the drainage outlets of the separator device.

DETAILED DESCRIPTION OF THE INVENTION

Figure 1:
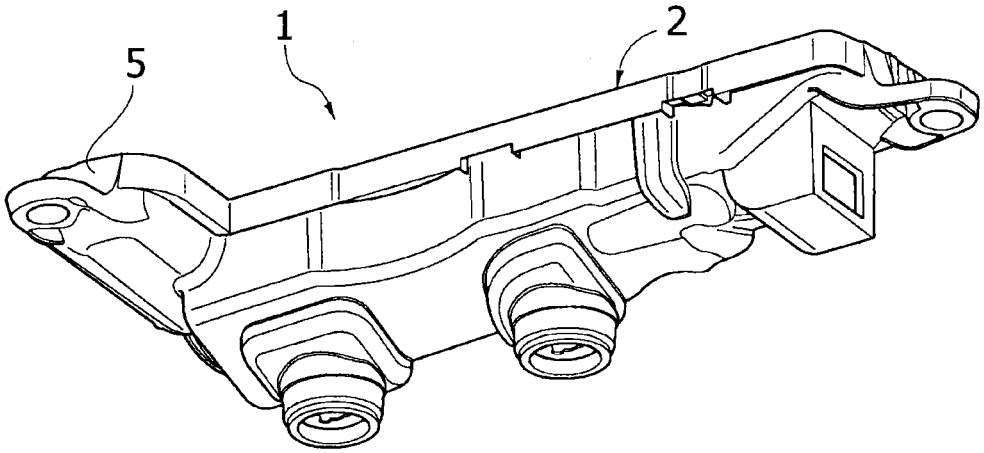
FIG. 1 is a perspective view of an embodiment of the separator device according to the invention.

Referring to FIG. 1, number 1 indicates in its entirety, a separator device used in a system for the recirculation of the blow-by gases of an internal combustion engine 100. The illustrated example specifically refers to the case of an in-line two cylinder engine with cranks offset by 0°, i.e. with pistons moving in the same direction towards the top dead centre and towards the bottom dead centre. The separator device 1 has a casing 2 defining a separation chamber 3 therein (FIG. 2) and having an inlet 4 communicating with the environment of the engine crankcase, an outlet 5 connected to the engine intake manifold or in any case to the engine air intake system and any number of outlets 6 for draining the oil separated in the chamber 3, ending in a cavity of the engine crankcase (two outlets 6 are provided in the illustrated example).

As observable in detail in FIG. 4, a leaf shutter 7 is provided constituted by at least one flexible metal leaf—anchored to the casing 2 of the device at 8—which is maintained adhering to a wall 2*a* in which the opening constituting the inlet 4 when the engine crankcase is under vacuum is provided, while it bends allowing the entry of the blow-by gases and vapours mixture and oil droplets into the separator 2 when the pressure in the engine crankcase is higher than the pressure value in the separator device 2 at the inlet 4.

Figure 2:
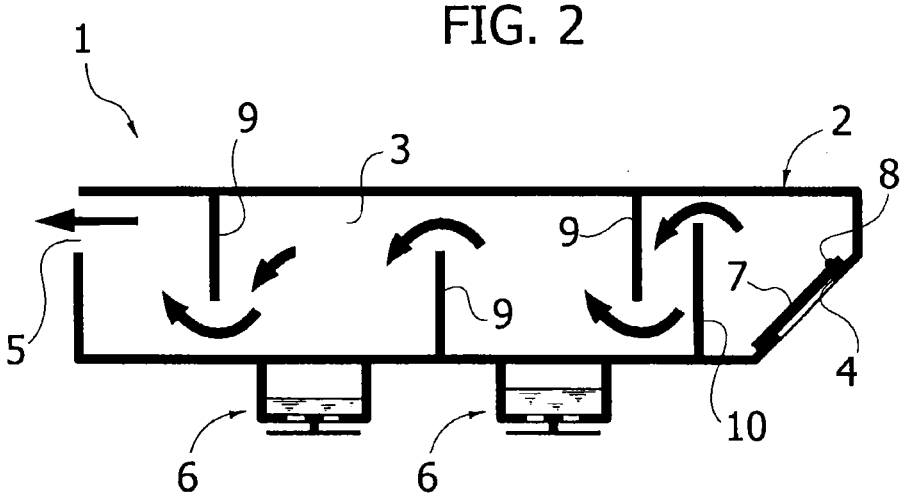
FIG. 2 is a sectional schematic view of the separator device of FIG. 1.
Figure 3:
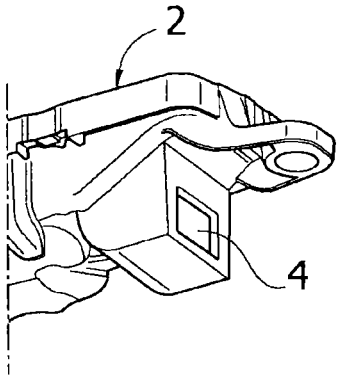
FIG. 3 is an enlarged scale perspective view of a detail of FIG. 1.

Still referring to FIGS. 2, 4, several partitions 9 defining a labyrinth path are provided in the casing 2. A first partition immediately adjacent to the inlet 4, indicated with 10 in FIG. 4, is arranged and configured so that the mixture flowing into the separator device impacts thereagainst, facilitating separation.

Figure 7:
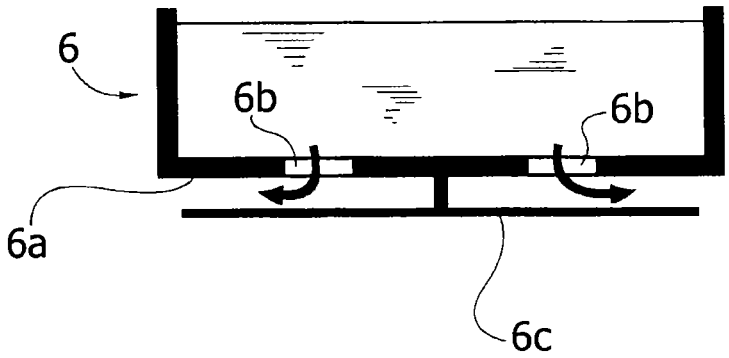
FIG. 7 is an enlarged scale sectional view of the detail of FIG. 5.

The drainage outlets 6 are provided in form of cylindrical wells arranged on the bottom of the casing 2 of the separator, each well having a bottom wall 6*a* whereon the olio separated in the separation chamber 3 is collected. The bottom wall 6*a* has a plurality of passages 6*b* (see FIG. 6) which are controlled by a T-shaped shutter 6*c*, schematically represented in the drawings (see FIG. 7 in particular). Each T-shaped shutter has a stem with a widened end fixed onto the body of the separator and a disc-shaped head constituting a flexible membrane which is deformed opening and closing the passages 6*b* varying the pressure in the engine crankcase.

In the present description and in the attached drawings the construction details related to the flexible leaf 7 and the shutters 6*c* are not shown, given that such details may be provided in any known manner and also due to the fact the elimination of such details of the drawings allows instant and easy understanding thereof.

Figure 8:
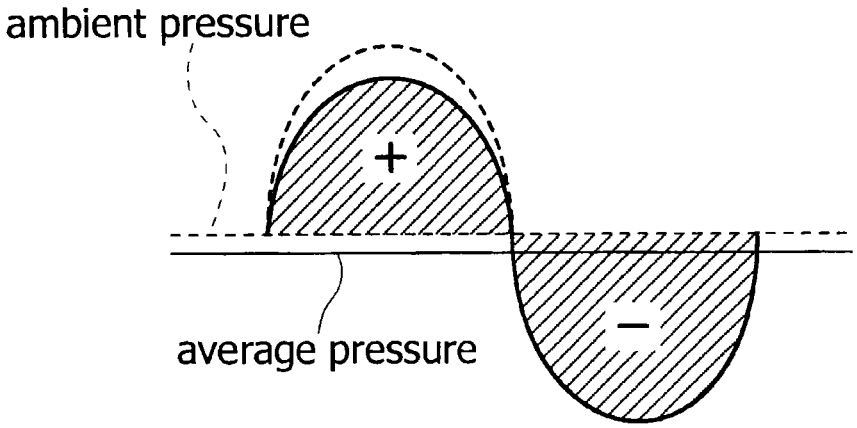
FIG. 8 is a diagram illustrating the variation cycle of the pressure in the engine crankcase of the engine according to the invention.

FIG. 8 shows the variation cycle of the pressure in the engine crankcase of an in-line two cylinder engine of the aforedescribed type, with pistons moving in the same direction, over time. As observable, the instantaneous pressure in the engine crankcase considerably varies as a function of the sensitive variation of the volume of the engine crankcase over a rotation of the engine shaft, due to the movement of the pistons in the same direction. When the pistons move towards the top dead centre, the volume of the engine crankcase increases, hence creating an environment under vacuum. On the contrary, when the two pistons move towards the bottom dead centre, the volume of the engine crankcase reduces and the environment is subjected to pressure.

Figure 9:
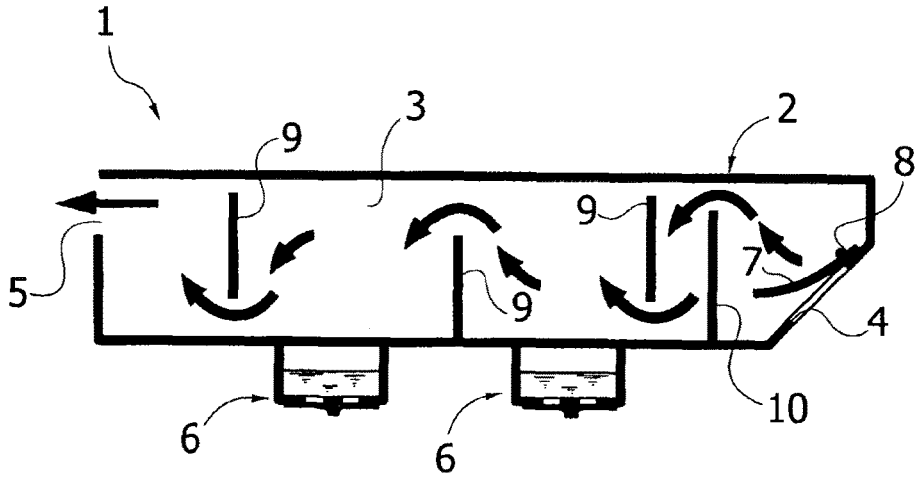
FIGS. 9, 10 are schematic views of the separator device according to the invention showing the two different steps of the operative cycles of the device according to the invention.
Figure 10:
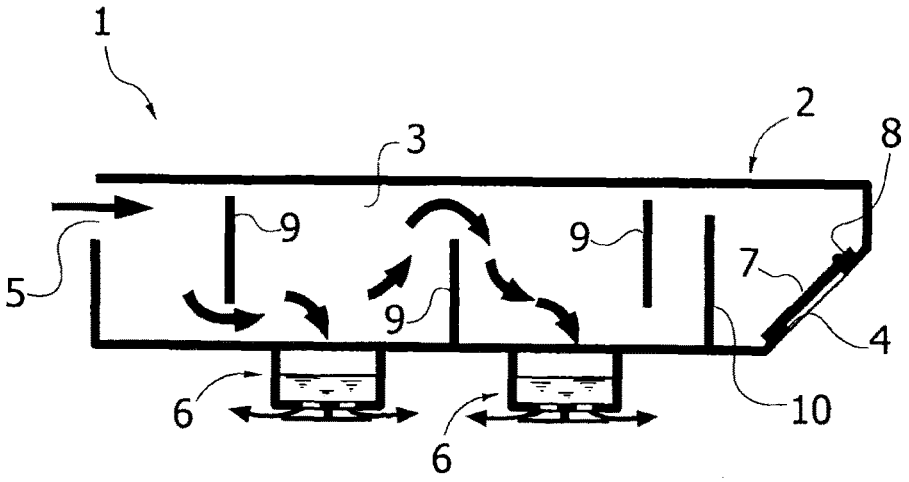
Figure 11:
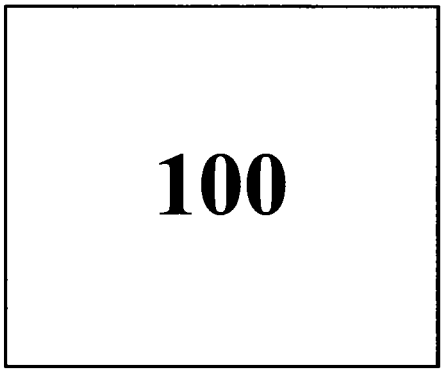
FIG. 11 is a graphical representation of a two cylinder internal combustion engine having cranks offset by 0° in accordance with the present invention.

FIGS. 9, 10 show the two steps of the operative cycle of the device according to the invention. FIG. 9 refers to the step wherein the pressure in the engine crankcase is higher than the pressure in the separator device. Under such condition, the leaf shutter 7 is open and the T-shaped shutters 6*c* are closed, the mixture follows the labyrinth path from the inlet 4 to the outlet 5 so as to allow the separation of olio and the return of the blow-by gases to the engine intake.

FIG. 10 refers to the step in which the pressure in the engine crankcase is lower than the pressure in the separator device. In such step the leaf shutter 7 is closed and the T-shaped shutters 6*c* open allowing draining the oil separated in the chamber 3 in the engine crankcase. In such step, the vacuum present in the engine crankcase creates an airflow from the engine intake through the outlet 5, the chamber 3 of the separator and the wells 6. As previously indicated, such airflow also serves the function of cleaning the engine crankcase, contributing to reduce the contamination of the oil by the blow-by gases and thus obtaining a positive crankcase ventilation without requiring a PRV valve or the like.

Still according to the invention, the entire section of passage through the holes 6*b* associated to the wells 6 is however much smaller than the inlet passage 4 in the separator. Therefore, the negative half wave of the pressure cycle in the crankcase has a larger area with respect to the positive half wave. Thus, the average pressure in the crankcase is negative (see FIG. 8). Generally, the size of the drainage holes 6*c* and 6*b* is selected so as to have a desired impact on the vacuum level generated in the engine crankcase.

For the same reason, the motion of the mixture in the separator is prevalent towards the outlet. Furthermore, as observable from a comparison of FIG. 9 with FIG. 10, the return through the drainage outlets 6 occurs along a different path with respect to that of the vapours in the step of FIG. 9 hence guaranteeing good separation in the step illustrated in FIG. 9.

Naturally, without prejudice to the principle of the invention, the details and embodiments may vary, even significantly, with respect to what has been described and illustrated strictly for exemplification purposes, without departing from the scope of the present invention.

What is claimed is:

1. A separator device for a system for recirculation of the blow-by gases of a two cylinder internal combustion engine, comprising:

a casing containing a separation chamber and having an inlet for communication with an engine crankcase of a two cylinder internal combustion engine having cranks offset by zero degrees such that two pistons are movable simultaneously in a same direction towards a top dead center and towards a bottom dead center of the two cylinder engine, an outlet for communication with an engine intake system and a plurality of drainage outlets ending in the engine crankcase for discharging the separated liquid into the separation chamber, said inlet comprising a flexible metal leaf inlet shutter configured to open in response to an increase in a pressure in the engine crankcase caused by the two pistons moving toward a bottom dead center and configured to close in response to a decrease in the pressure caused by the pistons moving away from the bottom dead center;

said separation chamber comprising a labyrinth path for flow of blow-by gases between said inlet and said outlet, said path comprising a plurality of partitions, a top wall and a bottom wall bounding said path, said plurality of drainage outlets located directly on said bottom wall;

a first partition of said plurality of partitions located adjacent said inlet and a second partition of said plurality of partitions located adjacent said outlet, said first partition connected to said bottom wall of said separation chamber and spaced from a top wall of said chamber and said second partition connected to said top wall of said separation chamber and spaced from said bottom wall of said chamber;

a third partition of said plurality of partitions and a fourth partition of said plurality of partitions located between said first partition and said second partition along said longitudinal dimension of said separation chamber, said third partition located closer to said first partition than to said second partition and connected to said top wall of said separation chamber and spaced from said bottom wall of said chamber, said fourth partition located closer to said second partition than to said first partition and connected to said bottom wall of said separation chamber and spaced from said top wall of said chamber;

a first drainage outlet of said plurality of drainage outlets is located between said third partition and said fourth partition along said longitudinal dimension of said separation chamber;

a second drainage outlet of said plurality of drainage outlets is located between said fourth partition and said second partition along said longitudinal dimension of said separation chamber;

each drainage outlet of said plurality of drainage outlets comprising at least one T-shaped outlet shutter configured to open in response to a decrease in the pressure within said engine crankcase and to close in response to an increase in the pressure within said engine crankcase;

said plurality of drainage outlets allowing fluid communication between said chamber and said crankcase when said plurality of drainage outlets is open to allow a drainage of the fluid in said chamber; and wherein an entire area of a passage defined by said plurality of drainage outlets is sized so that a desired vacuum level is provided to promote flow of the fluid through said plurality of drainage outlets to said engine crankcase in response to the decrease in the pressure, said plurality of drainage outlets being smaller than an area of a passage through said inlet, so that a negative half wave of a pressure cycle in the engine crankcase has a larger area when said inlet is closed and said plurality of drainage outlets is open with respect to a positive half wave when said inlet is open and said at least one drainage outlet is closed such that an average pressure in the engine crankcase is negative.

2. The device of claim 1, wherein the at least outlet shutter comprises a T-shaped shutter having a flexible membrane, the membrane being deformable to open and close a passage through the at least one drainage outlet.

3. The device of claim 1, wherein the inlet shutter is closed when the outlet shutter is open and the outlet shutter is open when the inlet shutter is closed.

4. The device of claim 1 wherein the T-shaped shutter comprises a flexible membrane which opens in response to the decrease in the pressure and closes in response to the increase in the pressure.

5. A separator device system for an internal combustion engine, comprising:

a separation chamber having an inlet for communication with an engine crankcase of an in-line two-cylinder engine or a one-cylinder engine, an outlet for communication with an engine intake system and a plurality of drainage outlets; said inlet comprising a flexible metal leaf inlet shutter configured to open in response to an increase in a pressure provided by one or more pistons of the in-line two-cylinder engine or the one-cylinder engine moving toward a bottom dead center and closes in response to a decrease in the pressure provided by the one or more pistons moving away from the bottom dead center;

each drainage outlet of said plurality of drainage outlets comprising a T-shaped outlet shutter configured to open in response to the decrease in the pressure and closes in response to the increase in the pressure;

said inlet shutter being closed when said at least one outlet shutter is open in response to the increase in the pressure and said inlet shutter being open when said at least one outlet shutter is closed in response to the decrease in the pressure;

said plurality of drainage outlets allowing fluid communication between said chamber and the crankcase when said at least one drainage outlet is open to allow a drainage of a fluid in said chamber to the crankcase; a labyrinth path of said separation chamber for flow of blow-by gases between said inlet and said outlet, said path comprising a plurality of partitions and a bottom wall bounding said path, said plurality of drainage outlets located directly on said bottom wall;

wherein each drainage outlet of said plurality of drainage outlets is separated along said longitudinal dimension of said separation chamber from each other drainage outlet of said plurality of drainage outlets by a partition of said plurality of partitions located therebetween along said longitudinal dimension;

each partition of said plurality of partitions having a longitudinal dimension aligned substantially perpendicularly to said longitudinal dimension of said separation chamber to promote a separation of oil from the blow-by gases;

said inlet located at a first end of said path and said outlet located at a second end of said path, said plurality of partitions located between said inlet and said outlet; and a first partition of said plurality of partitions located adjacent said inlet and a second partition of said plurality of partitions separated from each other along said longitudinal dimension of said separation chamber, said second partition located adjacent said outlet, said first partition connected to said bottom wall of said separation chamber and spaced from a top wall of said chamber and said second partition connected to said top wall of said separation chamber and spaced from said bottom wall of said chamber;

a third partition of said plurality of partitions and a fourth partition of said plurality of partitions located between said first partition and said second partition along said longitudinal dimension of said separation chamber, said third partition located closer to said first partition than to said second partition and connected to said top wall of said separation chamber and spaced from said bottom wall of said chamber, said fourth partition located closer to said second partition than to said first partition and connected to said bottom wall of said separation chamber and spaced from said top wall of said chamber;

a first drainage outlet of said plurality of drainage outlets located between said third partition and said fourth partition along said longitudinal dimension of said separation chamber;

a second drainage outlet of said plurality of drainage outlets located between said fourth partition and said second partition along said longitudinal dimension of said separation chamber; and wherein an area of a passage through said plurality of drainage outlets is smaller than an area of a passage through said inlet such that a flow of gas from the outlet though said plurality of drainage outlets in response to the decrease provides a positive crankcase ventilation without using a pressure regulation valve.

6. The system of claim 5 further comprising means for opening said inlet shutter in response to an increase in a pressure in the engine crankcase caused by the two pistons moving toward a bottom dead center and means for closing said inlet shutter in response to a decrease in the pressure caused by the pistons moving away from the bottom dead center.

7. The system of claim 5 further comprising means for providing fluid communication between said engine crankcase and said path via said inlet when said one or more cylinders of the in-line two-cylinder engine or the one-cylinder engine move toward a bottom dead center and means for providing fluid communication between said engine and said path via said at least one drainage outlet when said one or more cylinders move away from the bottom dead center.

8. A method for separating oil from a flow of blow-by gases which are recirculated from a crankcase of a two-cylinder internal combustion engine to an air intake of the engine, wherein said two-cylinder internal combustion engine has two cranks offset by zero degrees, such that two pistons are movable simultaneously in a same direction towards a top dead center and towards a bottom dead center of the two-cylinder internal combustion engine, so that a pressure in the engine crankcase has a periodical variation, according to a pressure cycle including a negative pressure half-wave, when the pistons move towards the top dead center, followed by a positive pressure half-wave, when the pistons move towards the bottom dead center, said method comprising:

providing a separator device including a casing containing a separation chamber and having an inlet for communication with said engine crankcase, an outlet for communication with the engine air intake and a labyrinth path within said separation chamber for flow of blow by gases between said inlet and said outlet, said path comprising a plurality of partitions and a bottom wall bounding said path, and at least one oil drainage outlet located on said bottom wall for discharging into the engine crankcase of oil separated from the blow by gases flowing through said path of said separation chamber, said inlet comprising an inlet shutter which is caused to open in response to an increase in the pressure within the engine crankcase caused by the two pistons moving toward a bottom dead center, said inlet shutter being caused to close in response to a decrease in the pressure within the engine crankcase;

said at least one oil drainage outlet defining a passage area which is smaller than a passage area defined by said inlet and said at least one oil drainage outlet comprising an outlet shutter which is caused to open in response to a decrease in the pressure within said engine crankcase and said outlet shutter being caused to close in response to an increase in the pressure within said engine crankcase, so that during said positive pressure half-wave of the pressure variation in the engine crankcase the inlet shutter opens and the drainage outlet shutter remains closed, and blow-by gases flow from the engine crankcase through said labyrinth path of the separation chamber to said engine air intake, oil contained in the blow-by gases being separated in said labyrinth path and being collected towards said bottom wall of the separation chamber, whereas during said negative pressure half-wave of the pressure variation in the engine crankcase the inlet shutter is closed and the drainage outlet shutter is opened, so that the previously separated oil is discharged into the engine crankcase through said at least one drainage outlet, while a flow of air is induced from the engine air intake through the separator outlet towards said at least one drainage outlet, so as to favor discharge of the separated oil, said smaller passage area of the drainage outlet compared with that of the separator inlet causing that said negative pressure half-wave of the pressure variation has a larger area than said positive pressure half-wave of the pressure variation, so as to give rise to an average negative pressure in the crankcase.

9. The method of claim 8 wherein a first partition of said plurality of partitions is located adjacent said inlet and a second partition of said plurality of partitions separated from each other along said longitudinal dimension of said separation chamber, said second partition located adjacent said outlet, said first partition connected to said bottom wall of said separation chamber and spaced from a top wall of said chamber and said second partition connected to said top wall of said separation chamber and spaced from said bottom wall of said chamber.

10. The method of claim 9 wherein a third partition of said plurality of partitions and a fourth partition of said plurality of partitions are located between said first partition and said second partition along said longitudinal dimension of said separation chamber, said third partition located closer to said first partition than to said second partition and connected to said top wall of said separation chamber and spaced from said bottom wall of said chamber, said fourth partition located closer to said second partition than to said first partition and connected to said bottom wall of said separation chamber and spaced from said top wall of said chamber.

11. The method of claim 10 wherein a first drainage outlet of said plurality of drainage outlets is located between said third partition and said fourth partition along said longitudinal dimension of said separation chamber.

12. The method of claim 11 wherein a second drainage outlet of said plurality of drainage outlets is located between said fourth partition and said second partition along said longitudinal dimension of said separation chamber.

* * * * *